United States Patent [19]

Aldinio et al.

[11] Patent Number: 4,476,640

[45] Date of Patent: Oct. 16, 1984

[54] DEVICE FOR CONTROLLING THE FLEX OF SKI AND THE LIKE BOOTS

[75] Inventors: Giuseppe Aldinio, Treviso; Giorgio Baggio, S. Martino Di Lupari, Italy

[73] Assignee: Nordica S.p.A., Montebelluna, Italy

[21] Appl. No.: 324,370

[22] Filed: Nov. 24, 1981

[30] Foreign Application Priority Data

Dec. 2, 1980 [IT] Italy ..... 26385 A/80
Dec. 2, 1980 [IT] Italy ..... 23531/80[U]

[51] Int. Cl.[3] ..... A43B 5/04
[52] U.S. Cl. ..... 36/121
[58] Field of Search ..... 36/121, 117, 118, 119, 36/120

[56] References Cited

U.S. PATENT DOCUMENTS

| | | | |
|---|---|---|---|
| 3,619,914 | 11/1971 | Hanson et al. | 36/121 |
| 3,633,291 | 1/1972 | Caporicci | 36/121 |
| 3,718,995 | 3/1973 | Graup | 36/121 |
| 4,173,084 | 11/1979 | Kirsch | 36/121 |

*Primary Examiner*—Patrick D. Lawson
*Attorney, Agent, or Firm*—Guido Modiano; Albert Josif

[57] ABSTRACT

The device comprises an adjusting element having a variable working length and being associated, at the ends thereof, with two separate and mutually movable points on a boot, the adjusting element including a cylindrical body on the interior whereof a piston is slidably mounted which acts on a fluid and a valve controlling the passage opening of the fluid for varying the elastic bias developed by the adjusting element as it is adjusted in one direction independently from the bias applied during an adjustment in the opposite direction.

5 Claims, 11 Drawing Figures

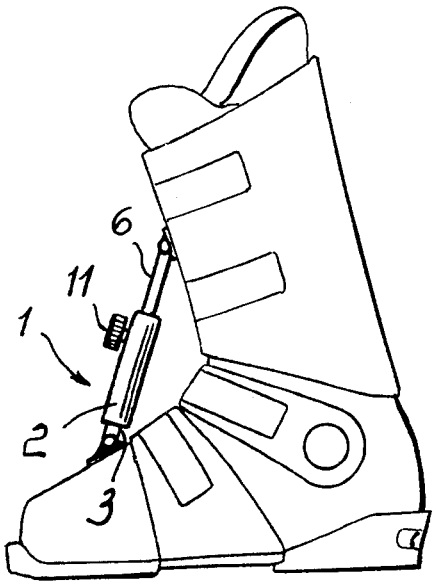
Fig.1
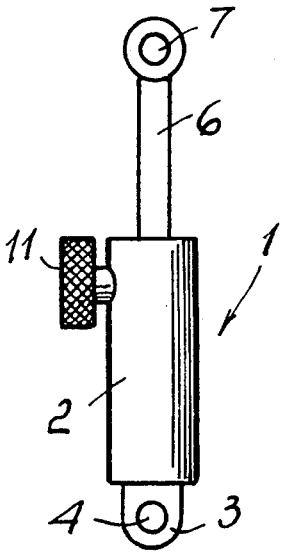
Fig.2
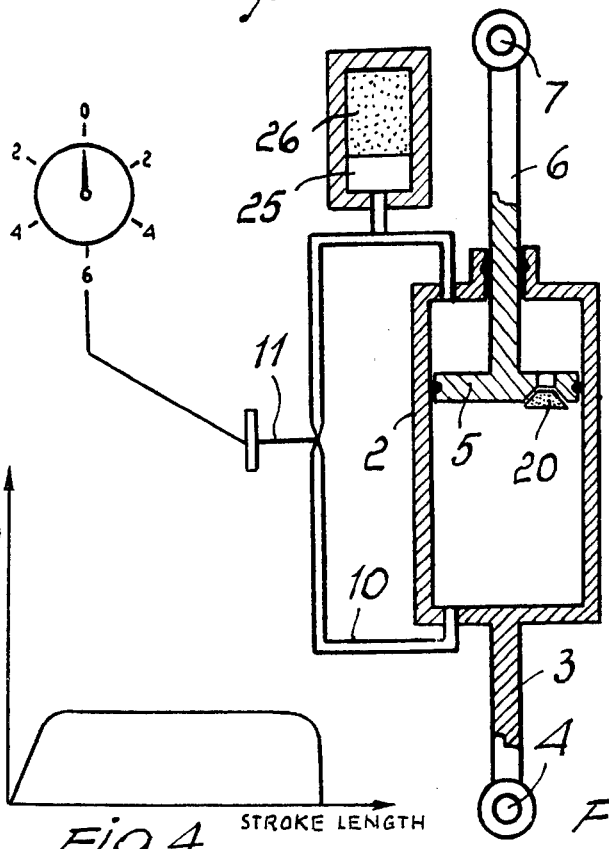
Fig.3
Fig.4
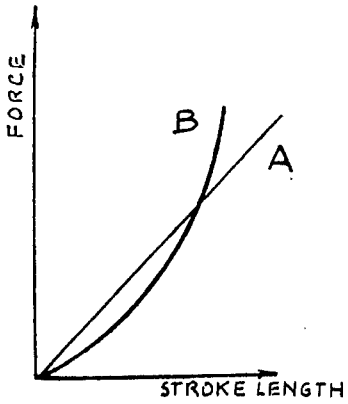
Fig.5

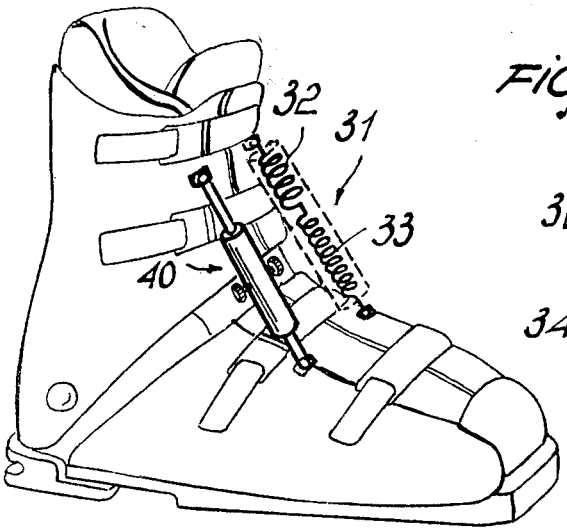
Fig.6
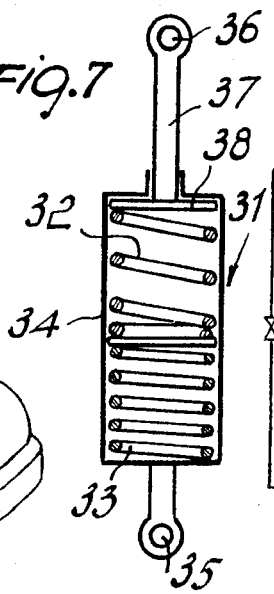
Fig.7
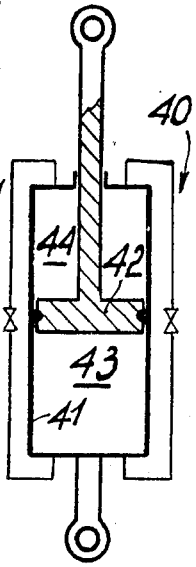
Fig.8
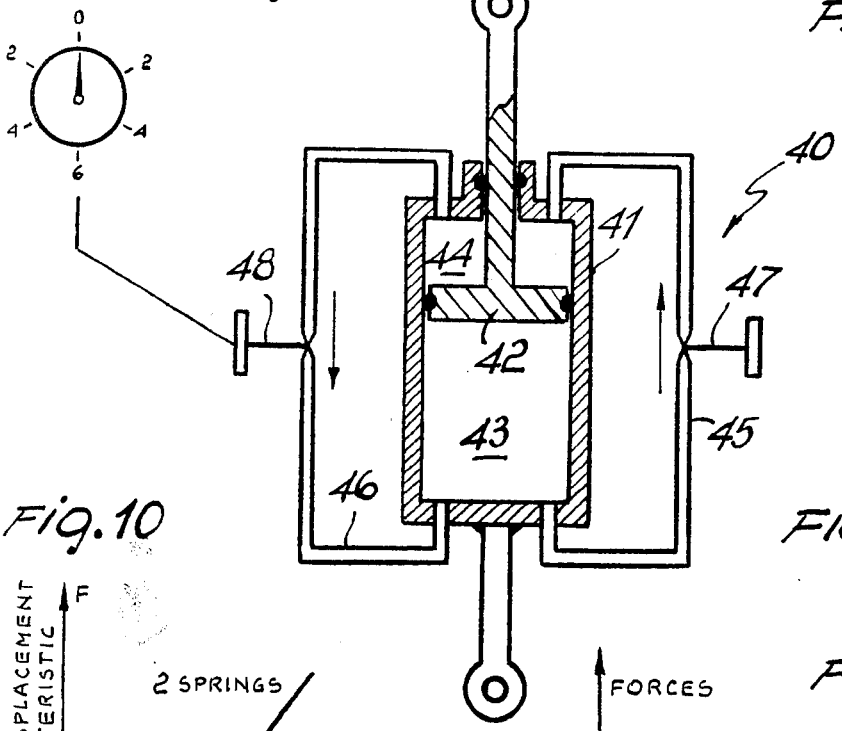
Fig.9
Fig.10
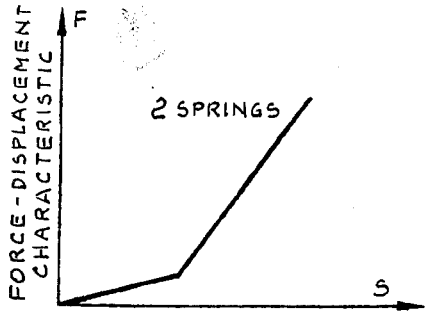
Fig.11
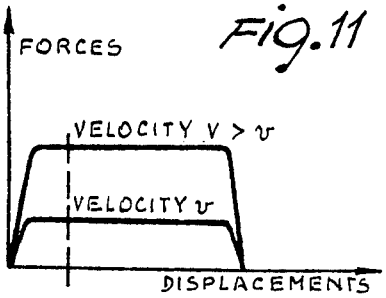

DEVICE FOR CONTROLLING THE FLEX OF SKI AND THE LIKE BOOTS

BACKGROUND OF THE INVENTION

This invention relates to a device for controlling the flex of ski and the like boots.

It is a well known fact that a currently much felt problem in the ski boot industry is that of providing a selectable form of flex adjustment for a ski boot, because the extent of the flex directly affects in practice the effort required to lean the skier's lower leg portion forwardly.

U.S. Pat. No. 3,686,778 discloses a ski boot which is provided, located between the boot shell and cuff, with elastic means for controlling the swinging movement of the cuff relatively to the shell in a back and forward direction, which means comprise, for example, a hydraulic cylinder connected to the boot shell, wherein a piston is movable the rod whereof is linked to the cuff portion.

The piston is provided with a throttling means, made adjustable through a rod which is accessible from the outside, which means affords the possibility of varying the extent of the elastic bias by creating a greater or lesser opposition to the fluid flowing from one into the other of the chambers defined by the piston inside the cylinder.

The fluid is caused to flow through the cylinder, both because of forward leaning and rearward leaning of the cuff with respect to the shell.

With that approach, it occurs that the fluid, being forced to flow through the throttled or necked down port defined in the piston, affords no suitable action for the achievement of a differentiated opposition to the forward lean and rearward lean movements, so that it is impossible to adjust the two bias forces independently of each other.

SUMMARY OF THE INVENTION

Accordingly, the task of the present invention is to provide a device for controlling or adjusting the flex of a ski boot, from a minimum value, whereat the movements are practically unimpeded, up to a value whereat the boot is made completely rigid and disallows any relative movements between the two parts and in which the adjustng of the flex is achieved in such a manner as to differentiate from each other the elastic bias forces in the forward leaning and rearward leaning phases.

Within this task it is an object of this invention to provide a device for controlling the flex of a ski boot, which is extremely practical and versatile in use, it being capable, without introducing any special complications, of adjustng itself to any contingent requirements of the skier, while enabling him/her to operate quick adjustments.

The aforesaid task and object and yet other objects, such as will be apparent hereinafter, are achieved by a device for controlling the flex of a ski or the like boot, comprising a variable working length adjusting element associated, at the ends thereof, with two mutually movable points on a boot, said adjusting element including a cylindrical body on the interior whereof a piston is slidably mounted to act on a fluid, characterized in that it comprises calibration means adapted to vary the elastic bias exerted by said adjusting element when dimensionally adjusted in one direction independently of the elastic bias exerted when dimensionally adjusted in the opposite direction.

BRIEF DESCRIPTION OF THE DRAWINGS

Further features and advantages will be more clearly apparent from the detailed description of a device for controlling the flex of a ski and the like boot, illustrated by way of example and not of limitation in the accompanying drawings, where:

FIG. 1 illustrates schematically a control device according to the invention as applied on a boot;

FIG. 2 elucidates the configuration of the adjusting element;

FIG. 3 is a schematic sectional view illustrating the operation of the control device according to the invention;

FIGS. 4 and 5 represent force/stroke length graphs of some possible embodiments of the device;

FIG. 6 shows a ski boot with a modified control device;

FIG. 7 shows a detail of the embodiment of FIG. 6;

FIG. 8 illustrates another detail of the embodiment of FIG. 6;

FIG. 9 is a schematic sectional view of a part of the decelerator of FIG. 6;

FIG. 10 is a spring response graph; and

FIG. 11 is a response graph of the decelerator as a function of the velocity of the applied impulse.

DESCRIPTION OF THE PREFERRED EMBODIMENTS

With reference to FIGS. 1 to 5, a device for controlling the flex of ski and the like boots, according to this invention, comprises an adjustment element, generally indicated at 1, of variable working length. The adjustment element 1 is associated, at the ends thereof, with two mutually movable points on a boot; thus, for example, it may be mounted between one point on the boot shell and another point located on the boot cuff, between two points on the shell, between two points on the cuff, or between two points on the boot vamp. If desired, the adjustment element 1 may also be associated with the rear portion of a boot, between one point on the shell and another on the rear cuff portion, or in any suitable manner, so long as the principle is observed of mounting it between any two points or a first and a second portion of the boot the separating distance or spacing wherebetween undergoes mutual variation as the skier's leg flexes in skiing.

The cited adjustment element 1 comprises a cylindrical body or cylinder 2, which is provided with a projection or lug 3 at one end, having a throughgoing hole 4 for pivotally connecting it to a portion of the boot.

Within said cylindrical body 2, there is slidably accommodated a piston 5 having a piston rod 6 arranged to move in tight sealed relationship through the base of the cylindrical body 2 and being provided, at the free end thereof, with an eye 7 for pivotally connecting it to another portion of the boot.

The cited piston 5 divides the cylinder 2 into two chambers and acts on a liquid or fluid medium which, in a manner to be explained hereinafter, provides the desired resistance to the boot flexure because of fluid passages between the two chambers, as will be seen hereinafter.

Said fluid is contained within the cylindrical body 2, and a circuit or conduit 10 is provided externally of the cylinder 2 for connecting the inner ends of the cylindrical body, that is the chambers at opposite sides of the piston 5, to each other.

The external circuit 10 includes calibration means in form of valve means, which comprise in practice an adjusting knob 11, effective to practically adjust and control the hydraulic resistance encountered by the fluid in flowing through the external circuit 10.

Thus, by suitably manipulating the knob 11 in accordance with contingent requirements, one can vary, continuously and with great accuracy, the bias force being applied by the adjustment element during the dimensional adjustment in one direction, which in the example shown in the drawing, correspnds to a shortening of the stroke length.

The device further comprises, a one way valve 20 provided in the piston 5, which valve is adapted to permit a dimensional variation of the adjustment element in the opposite direction, i.e. for lengthening purposes as shown in the drawing, without meeting with any opposition.

It should be pointed out that, as is usual with pistons utilizing a non-compressible fluid medium, a surge chamber 25 is provided in the external circuit 10 which compensates for the volume of the rod 6; on the interior of said chamber, there is provided a body of closed cell sponge rubber 26, which is compressed when subjected to pressure and expands as the pressure is removed. Of course, the actual configuration of the surge chamber may be modified as desired, only the principle which makes its presence indispensable requiring observance.

In operation, it occurs that the forward flexing of the skier's leg causes the piston 5 to compress the fluid and force it through the external circuit 10 where it will encounter a direct resistance the amount of which is a function of the calibration effected by means of the know 11. During this stage of the device operation, the one way valve 20 remains tightly closed, thereby it closes communication between the chambers of the cylinder 2 and does not allow a direct passage of the fluid in the cylindrical body 2, from above to below the piston, and viceversa.

Thus, the fluid is forced to flow through biasing movement of the piston, and can flow at a higher or lower velocity according to the calibration which has been effected by means controlling the fluid flow, so that adjustment element is more or less decelerated in accordance with said calibration.

As the skier returns to his/her original position, the fluid which had been transferred into the upper chamber of the cylindrical body 2 flows almost instantaneously into the lower chamber, thanks to the one way valve 20 which is now open and allows communication between the chambers of the cylinder 2. The valve 20 defines a sufficiently large orifice to opposse virtually no resistance to the return movement of the piston.

In other words, it occurs that the device described hereinabove behaves in practice as an energy sink which may be implemented in various ways to meet different energy absorption requirements.

In accordance with a modified embodiment of the invention, which is closely related in concept to the one just described, and which is illustrated in FIGS. 6 to 11, the device for controlling the flex of a ski boot with modulation of the elastic response, comprises an elastic element, indicated at 31, which advantageously includes a first spring 32 and second spring 33, serially arranged relatively to each other and working in compression. The springs 32, 33 have different elastic rates, as will be seen later on.

The selection of the two springs, which at least in theory may be replaced with a single spring, will finally depend on the skill of the skier, his/her weight, and on whether the skier is a man or woman; advantageously, and as suggested in the graph of FIG. 10, a first spring with a low elastic constant may be provided, so that the application of a small force results in a large displacement, and a second spring with a higher constant so that to obtain the desired displacement a larger force is required.

Said springs, which would be preferably enclosed in a cylindrical casing 34, will act between two mutually movable portions of the boot; thus, for instance, the eye 35 associated with the cyindrical casing 34 may be pivotally connected to the boot shell, whereas the upper eye 36 provided at the end of the rod 37 of the piston 38 which acts on the spring assembly 32, 33 may be pivotally connected to a point on the boot cuff. As visible from FIG. 7, the piston 38 engages one end of one of the springs, namely spring 32, adjacent one end of the cylindrical casing 34, so that compression of spring 32 causes compression also of spring 33.

To prevent the elastic energy stored during the spring compression phase from being suddenly released upon removal of the applied force, in combination with the elastic element 31, a decelerator, indicated at 40, is provided which comprises a cylindrical body or cylinder 41, on the interior whereof a piston 42 is slidable in sealed relationship which divides the interior of the cylindrical body 41 into a lower chamber 43 and upper chamber 44.

The chambers 43 and 44 are interconnected by a first one way conduit 45 extending from said chamber 43 to said chamber 44, and by a second one way conduit 46 extending from said chamber 44 to said chamber 43.

In the first one-way conduit 45, there are provided first adjustable one-way valve means 47 while second adjustable one-way valve means 48 are provided in the second conduit 46. As indicated by the arrows in FIG. 9, the one-way valves 47 and 48 are arranged to act in opposite directions with respect to one another.

Internally to the cylindrical body 41, a fluid medium is provided, preferably a non-compressible liquid, which, in accordance with the action exerted by the piston, will be forced from one chamber into the other flowing through one of said one way conduits.

With reference to the drawing, to only control or adjust the return step of the boot into the starting position, it will be necessary to hold the first valve means 47 fully opened, so that they cannot induce undue pressure losses and consequently a resistance during the leaning step, and calibrate in accordance with contingent requirements the second valve means, thereby it is also possible to control the return step as desired, so that said step can take place in any desired mode.

Of course, it is also possible to act on the first valve means to control the elastic bias during the forward leaning step.

A peculiar feature is that the two adjustments of the elastic bias in the forward leaning and rearward leaning steps or phases, can be carried out independently of each other. In fact, the means for controlling fluid flow from one of the chambers of cylinder 2 or 41 to the other of these chambers are separate and independent from the means controlling fluid flow from the other of these chambers to the one of these chambers.

It will be appreciated from the foregoing that the invention fully achieves its objects, and in particular that the adjustment element described affords, with both its embodiments, the possibility for the user to control at will and with great accuracy the amount of flexure of the boot in accordance with his/her own contingent requirements.

The invention as conceived is susceptible to many modifications and variations without departing from the scope of the instant invention concept.

Moreover, all of the details may be replaced with other technically equivalent elements.

We claim:

1. A device for controlling the flex of a first portion of a ski boot or the like with respect to a second portion of said ski boot movable with respect to said first portion, comprising a cylinder pivoted to one of said portions and a piston slidable in said cylinder and having a piston rod pivoted to the other of said portions, said piston dividing said cylinder into two chambers having a fluid therein and means for biasing movement of said piston in said cylinder, wherein said means comprise fluid passages between said two chambers of said cylinder at opposite sides of said piston and means for controlling fluid flow through said passages, the means for controlling fluid flow from one of said chambers to the other of said chambers being separate and independent from the means for controlling fluid flow from said other of said chambers to said one of said chambers.

2. A device as claimed in claim 1, wherein said means for controlling fluid flow comprise calibration means including valve means in a conduit connecting said chambers externally of said cylinder.

3. A device as claimed in claim 1, wherein said means for controlling fluid flow comprise a one-way valve in said piston for closing communication between said chambers when said piston moves in one direction and for opening communication between said chambers when said piston moves in an opposite direction.

4. A device as claimed in claim 1, further comprising a cylindrical casing and a piston slidable in said cylindrical casing, said cylindrical casing being pivoted to one of said portions and said piston slidable therein having a piston rod pivoted to another of said portions, and two springs serially arranged with respect to each other in said cylindrial casing and having different elastic rates, said piston in said cylindrical casing engaging one end of one of said springs adjacent one end of said cylindrical casing such the compression of said one of said springs causes compression also of the other of said springs.

5. A device as claimed in claim 1, wherein said passages comprise a first one-way conduit interconnecting one of said two chambers with the other of said chambers, and a second one-way conduit interconnecting said other of said two chambers with said one of said chambers, and said means for controlling fluid flow comprise two adjustable one-way valves each arranged in one of said one-way conduits, said one-way valves being arranged to act in opposite directions with respect to one another.

* * * * *